US010032397B2

(12) United States Patent
Fergus et al.

(10) Patent No.: US 10,032,397 B2
(45) Date of Patent: Jul. 24, 2018

(54) BANNER DISPLAY WITH SWIVEL INTERFACE

(71) Applicants: Howard Fergus, Beaverton, OR (US); Gary Fergus, Beaverton, OR (US)

(72) Inventors: Howard Fergus, Beaverton, OR (US); Gary Fergus, Beaverton, OR (US)

( * ) Notice: Subject to any disclaimer, the term of this patent is extended or adjusted under 35 U.S.C. 154(b) by 140 days.

(21) Appl. No.: 14/791,403

(22) Filed: Jul. 4, 2015

(65) Prior Publication Data

US 2016/0035258 A1 Feb. 4, 2016

Related U.S. Application Data

(60) Provisional application No. 62/020,970, filed on Jul. 3, 2014.

(51) Int. Cl.
*G09F 17/00* (2006.01)
*G09F 7/22* (2006.01)

(52) U.S. Cl.
CPC ..... *G09F 17/00* (2013.01); *G09F 7/22* (2013.01)

(58) Field of Classification Search
CPC ..... G09F 17/00; G09F 7/22
See application file for complete search history.

(56) References Cited

U.S. PATENT DOCUMENTS 1,945,789 A * 2/1934 Revis ..... G09F 7/22 352/98
2,116,050 A * 5/1938 Stock ..... F16C 11/10 174/86
2,810,223 A * 10/1957 Fraesdorf, Jr. ..... G09F 7/22 40/479
3,540,685 A * 11/1970 Gualano ..... G09F 17/00 116/173
3,850,401 A * 11/1974 Snediker ..... A47B 97/02 211/101
4,113,216 A * 9/1978 Fuse ..... G09F 7/002 248/291.1
5,070,809 A * 12/1991 Fox ..... E04H 12/32 116/173
5,477,437 A * 12/1995 Lach ..... G09F 17/00 116/173
5,904,116 A * 5/1999 Wyner ..... G09F 17/00 116/173
5,953,841 A * 9/1999 Sawyer ..... G09F 7/22 40/124.191
2011/0240824 A1* 10/2011 Wade ..... G09F 17/00 248/541
2015/0213741 A1* 7/2015 Bigham ..... G09F 17/00 116/173
2016/0036161 A1* 2/2016 Brown ..... H01R 39/64 439/271

* cited by examiner

*Primary Examiner* — Gary C Hoge
(74) *Attorney, Agent, or Firm* — Compass IP Law PC

(57) ABSTRACT

A banner or flag is affixed to a rigid portion of a banner arm that allows the banner to hang vertically for maximum display. The banner arm is mounted to a swivel head that enables 360 degree angular rotation. The rotation is about a rotational axis, which can also be vertical for maximum display and rotation. The swivel head mounts to a mounting system. The mounting system can include a mounting arm that mounts the banner to an object for display, or allows the banner to stand alone for display, depending on the type of mounting.

17 Claims, 8 Drawing Sheets

9246P001

BANNER DISPLAY WITH SWIVEL INTERFACE

PRIORITY

The present application is a non-provisional of U.S. Provisional Patent Application Ser. No. 62/020,970 filed Jul. 3, 2014, and claims the benefit of priority of that application. The provisional application is hereby incorporated by reference.

FIELD

Embodiments described are related generally to banner displays, and embodiments described are more particularly related to a banner display mount with a swivel.

COPYRIGHT NOTICE/PERMISSION

Portions of the disclosure of this patent document can contain material that is subject to copyright protection. The copyright owner has no objection to the reproduction by anyone of the patent document or the patent disclosure as it appears in the Patent and Trademark Office patent file or records, but otherwise reserves all copyright rights whatsoever. The copyright notice applies to all data as described below, and in the accompanying drawings hereto, as well as to any software described below: Copyright © 2014 and 2015, MorCreations, LLC, DBA MorSpin Flagpoles. All Rights Reserved.

BACKGROUND

Banners and flags are very popular displays of loyalty or association with a nation, group, affiliation, ideology, or other association. Banners have long been used to display loyalty to sports teams, clubs, and scholastic affiliations. Banners have also become popular displays of art or decoration in yards and gardens. Banners are typically mounted on some type of pole from which they hang. Typically displayed banners are only visible from a certain angle or perspective. The point of banners is to display a particular association or to display art, but traditional displays are limited in how they display the banner.

BRIEF DESCRIPTION OF THE DRAWINGS

The following description includes discussion of figures having illustrations given by way of example of implementations of embodiments described. The drawings should be understood by way of example, and not by way of limitation. As used herein, references to one or more "embodiments" are to be understood as describing a particular feature, structure, or characteristic included in at least one implementation. Thus, phrases such as "in one embodiment" or "in an alternate embodiment" appearing herein describe various embodiments and implementations, and do not necessarily all refer to the same embodiment. However, they are also not necessarily mutually exclusive.

Descriptions of certain details and embodiments follow, including a description of the figures, which can depict some or all of the embodiments described below, as well as discussing other potential embodiments or implementations of the inventive concepts presented herein.

DETAILED DESCRIPTION

As described herein, a banner display system enables greater movement and motion of a banner being displayed. Instead of hanging from a fixed pole and simply swaying side to side in a breeze, or hanging vertically and not moving at all, the banner can achieve swaying and motion from side to side as well as spinning about an axis. Thus, the full display desired from a vertical banner display can be achieved, but with increased action and movement in a breeze. Just as the dancing of flames or the twinkling of holiday light displays capture our attention, the banner display system captures the attention of the observer. The banner can hold an observer's attention in a way not possible with previous banner displays.

As described herein, the banner or flag is affixed to a rigid portion of a banner arm that allows the banner to hang vertically for maximum display. The banner arm is mounted to a swivel head that enables 360 degree angular rotation. The rotation is about a rotational axis, which can also be vertical for maximum display and rotation. The swivel head mounts to a mounting system. The mounting system can include a mounting arm that mounts the banner to an object for display, or allows the banner to stand alone for display, depending on the type of mounting.

Figure 1A:
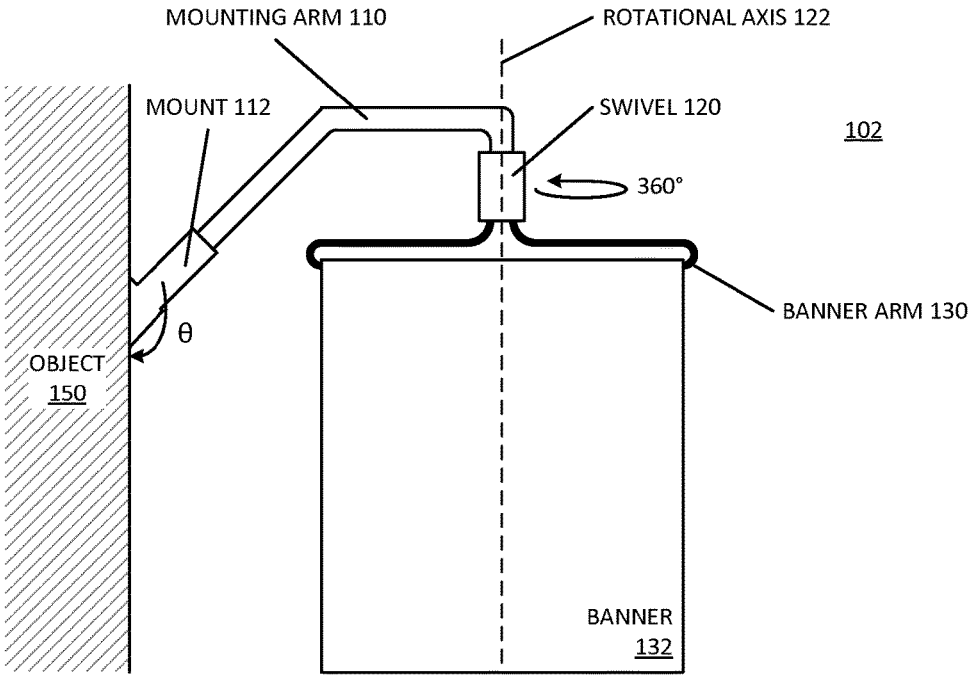
FIGS. 1A-1B are representations of embodiments of a flag mount system with a swivel interface.

FIG. 1A is a representation of an embodiment of a flag mount system with a swivel interface. System 102 represents an embodiment of a display system for a flag or banner. The descriptions below refer to display of banners. A banner can be understood as a more general term that encompasses flags, signs, and may also include other display items not necessarily considered to be flags. Thus, banner is used herein for description, and will be understood to include flags.

System 102 includes mounting arm 110 to hold the banner display and extend it from object 150 to which it is mounted for display. Mount 112 represents a mounting interface such as a flagpole bracket or other connector to connect the display system to object 150. Object 150 can be a house or other building, a structure such as a wall or fence or other structure, a vehicle (e.g., an RV (recreational vehicle)), or other object to which a banner or flag can be connected for display. Mount 112 can have an angle relative to object 150 and/or relative to the ground. Many conventional mounting systems offer options such as 30 degrees, 45 degrees, and/or 60 degrees. However, any angle could be accommodated.

Mounting arm 110 attaches to mount 112 and provides distance from object 150 to enable banner 132 to spin freely. Banner 132 mounts to banner arm 130, which can be any type of banner arm as described herein. Swivel interface or swivel head 120 connects to mounting arm 110, and provides 360 degrees of rotational motion for banner arm 130 with respect to the mounting arm. Thus, swivel 120 allows banner arm 130 a free range of motion with respect to mounting arm 110. Mounting arm 110 can remain stationary or fixed, and banner 132 can rotate about rotational axis 122. Rotational axis 122 will run vertically through swivel head 120 to allow full rotation of banner 132.

In general, a swivel head in accordance with embodiments described herein can be made of wood, metal, resin, plastic, and/or other material. Any part made of resin or plastic can be formed by injection molding or milled or otherwise machined. Any part made of metal, resin, or plastic can be created via 3D printing or other additive manufacturing. Parts made of pipe or other hollow metal can be curved, cut, bent or otherwise shaped to a desired form. Parts made of wood can be milled or otherwise machined. In general, there are no limits on the types of material or the types of manufacturing techniques used to fabricate the parts except to the extent such would be incompatible with a particular embodiment described.

Swivel head 120 allows a firm attachment to mounting arm 110, and a free-spinning attachment to banner arm 130. The rotation allowed by swivel head 120 can be thought of as coming perpendicularly out from the swivel, and banner arm 130 rotates around the axis. As illustrated, rotational axis 122 can come "straight down" with respect to the orientation of the system 102 on the page. The rotational axis should be vertical as the banner hangs vertically, to allow the full display of the banner to spin. In one embodiment, rotational axis 122 can intersect a straight banner arm orthogonally. In one embodiment, the axis of rotation is in-line with either a width or a length of the banner for rectangular banners 132. For banners of other shapes, rotational axis 122 can be in-line with an axis of symmetry of the banner.

In one embodiment, banner arm 130 is offset with respect to rotational axis 122 provided by swivel head 120. As such, the rotational axis can be offset with respect to an axis of symmetry of a banner 132. In one embodiment, the center of balance of banner arm 130 is in-line with the axis of rotation provided by swivel head 120. In one embodiment, banner arm 130 holds banner 132 to align an axis of symmetry of the banner to be in-line with the axis of rotation provided by the swivel. Swivel head 120 allows the banner to spin due to wind (whether natural or artificial). Banner arm 130 has a rigid or semi-rigid portion that will keep its shape and/or return to shape for display. Banner arm 130 can be made of metal or other material as described below, and can allow different ways to mount banner 132 to the banner arm.

Figure 1B:
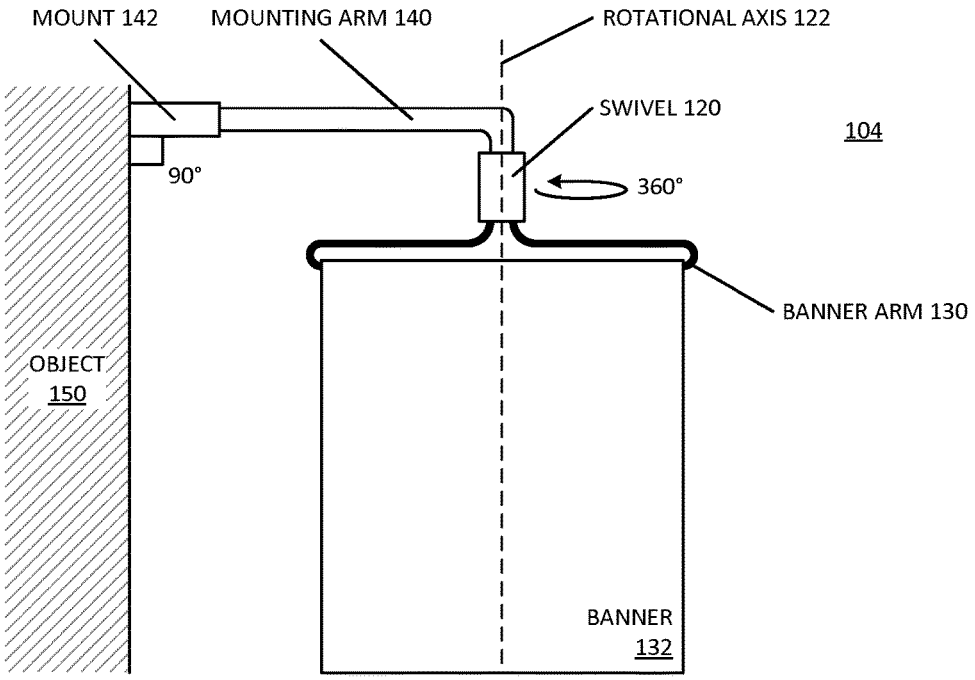

FIG. 1B is a representation of an embodiment of a flag mount system with a swivel interface. System 104 represents another type of mounting system, similar to system 102 of FIG. 1A. In one embodiment, swivel head 120, banner arm 130, banner 132, and object 150 can all be identical to what is described with reference to system 102. System 104 includes mount or mounting interface 142 that connects the display system to object 150, which can be any object, such as what is described above. The specific mount illustrated can provide a perpendicular or substantially perpendicular mount (within a few degrees) from object 150. In one embodiment, mounting arm 140 extends horizontally from mount 142 to provide distance for banner 132 from object 150. Other than the type of mounting, system 104 can include any variation discussed with reference to system 102.

In general, a mounting arm can be a straight pole or a shepherd hook style pole. The number of bends in the pole is not significant, and the poles can have distinct bends, or be bent in a continuous arc. In one embodiment, different swivel head interfaces can be used to connect the swivel head to the mounting arm to allow the banner arm to hang vertically with the banner arm posts substantially horizontal with respect to ground, and able to spin in 360 degrees. The swivel head and interface to the mounting arm can be for a specific mounting system, and/or can be applied as a retrofit piece to an existing flagpole.

Figure 2:
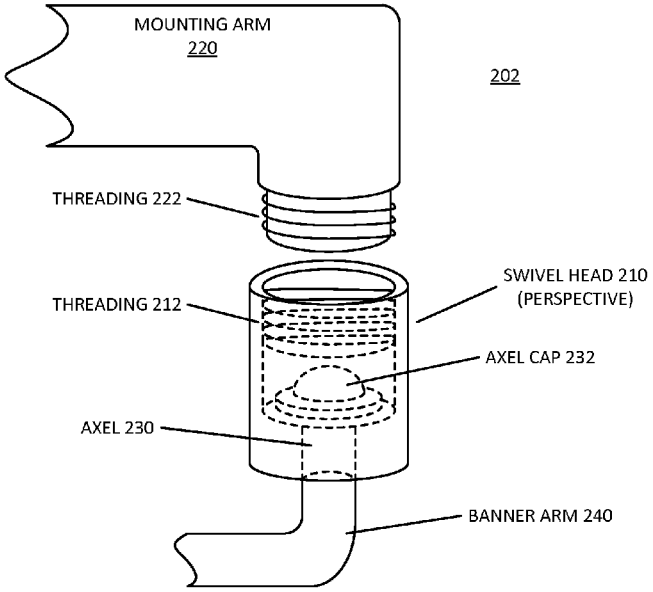
FIG. 2 is a representation of an embodiment of a swivel interface or swivel head.
Figure 2:
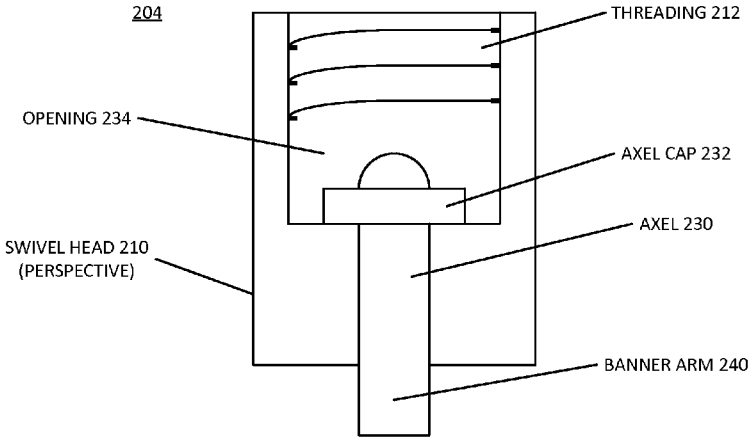

FIG. 2 is a representation of an embodiment of a swivel interface or swivel head. Mounting arm 220 can be any configuration described herein. While mounting arm 220 is illustrated as a 90 degree pole, the portion of mounting arm 220 illustrated is for illustrative purposes only, and is not limiting. In one embodiment, mounting arm 220 attaches securely to swivel head or swivel interface 210 via threading. For example, mounting arm 220 can include a male threaded portion 222 to interface with a female threaded portion 212 of swivel head 210. In one embodiment, the mounting arm includes a female threaded portion and the swivel head includes a male threaded portion. It will be understood that other forms of secure mounting can be used.

A threaded interface can allow swivel head 210 and banner arm 240 to be detached from one mounting arm 220 and attached to another (not shown). Other forms of interface can include clips or other sockets with actionable interfacing pieces. Other interfaces can include a latch system where an outer portion of swivel head 210 can be moved down with respect to mounting arm 220 to allow the swivel head to disconnect from mounting arm 220. Connecting the two can be accomplished in similar fashion by depressing the outer portion of swivel head 220 to engage an inner portion with mounting arm 220, and then releasing the outer portion to spring back up to secure the swivel head to the mounting arm. Thus, for example, a user could depress a portion of the mounting arm and/or swivel head to disengage and/or engage the interface, where the interface locks when not depressed.

In one embodiment, swivel head 210 includes an axle and axle cap mechanism. Axle 230 represents an axle portion, and axle cap 232 represents the cap portion. Axle 230 can extend through a middle of swivel head 210, for example to an opening within swivel head 210. Consider, for example, a piece of plastic, wood, resin, or other rigid material with a smaller cylindrical opening through one end, and meeting up with a larger cylindrical opening of the other end. While perspective 202 does not explicitly show it, cross-section 204 illustrates one embodiment where there is an opening between threading 212 and a hole or via through which axle 230 extends. Axle cap 232 can be wider than the smaller via, and cap axle 230 at an interface between the wider inner portion and the narrower inner portion of swivel head 210.

In one embodiment, swivel head 210 can include a mechanism (such as threading, a clamping mechanism, a clipping mechanism, or other) on one end to attach to mounting arm 220. On the other end the swivel head attaches to banner arm 240. Perspective view 202 illustrates mounting arm 220, and cross-section view 204 illustrates banner arm 240. In one embodiment, swivel head 210 is permanently or semi-permanently attached to banner arm 240. In one embodiment, one portion or one end of banner arm 240 is axle 230 that attaches through a hole or via in swivel head 210. A via will be understood as an opening extending through the material of swivel head 210. The end of banner arm 230 can be capped with axle cap 232, which can prevent the banner arm from removing from swivel head 210, but allows banner arm 230 to spin freely with respect to swivel head 210. Attaching swivel head 210 to mounting arm 220 would thus allow banner arm 230 to spin freely with respect to mounting arm 220.

In one embodiment, a threading hole or other hole in one end of swivel head 210 opens to a hole through the other end of swivel head 210 (e.g., opening 234 can be an interface between the two holes or vias. Thus, swivel head 210 can include an axle cap on a banner arm end at the "bottom" of a threaded hole, referring to looking down into the threaded hole of the swivel head from the larger opening. Thus, in one embodiment, swivel head 210 includes a hole through a cylinder of the swivel head. In one embodiment, a similar mounting system can be employed and used with respect to mounting arm 220. For example, consider that instead of threads or other mechanisms, mounting arm 220 includes a portion that extends horizontally with respect to ground, and has a vertical opening or hole through the body of the mounting arm. In one embodiment, axle 230 can extend through that hole or opening and be capped at the other end of the hole. Thus, the end of mounting arm 220 with the opening through which axle 230 extends can act as a swivel head 210, in one implementation.

In one embodiment, swivel head 210 includes a washer or spacer or other mechanism to act as the axle cap and/or to interface axle cap 232 with a hole or via through the swivel head that allows attachment to banner arm 240. In one embodiment, axle 230 and axle cap 232 are separate pieces from banner arm 240, and banner arm 240 attaches to axle 230 in any conventional manner. In one embodiment, swivel head 210 includes one or more ball-bearing mechanisms. In one embodiment, the ball bearings can be in addition to axle cap 232 or in place of axle cap 232. In one embodiment, the ball bearings can be in addition to a spacer or in place of a spacer.

Perspective view 202 and cross section view 204 illustrate one embodiment of a swivel head 210. In one embodiment, the hole for threading 212 can extend through swivel head 210 to axle cap 232, and may or may not be threaded all the way to axle cap 232. In one embodiment, the hole for threading 212 or other attachment mechanism can extend through the swivel head to another mechanism such as a bearing interface or ball joint. The ball bearings and/or the ball joint can allow rotational freedom of the banner arm with respect to the mounting arm, similar to the axle and axle cap mechanism illustrated.

In one embodiment, swivel head 210 includes a central portion that rotates freely about a rotational axis, and extends down outside of the center of swivel head 210. In one embodiment, banner arm 240 is removably attachable to the portion that extends out of swivel head 210 along the rotational axis. Thus, swivel head 210 can interface with any of a number of mounting arms 220, and be removably connectable to any of them; and in in one embodiment, swivel head 210 can also be removably connectable to any number of different banner arms 240. Thus, in one embodiment, banner arm 240 can be switched out in a display system, and swivel head 210 can interface any banner arm 240 to any mounting arm 220.

Figure 3:
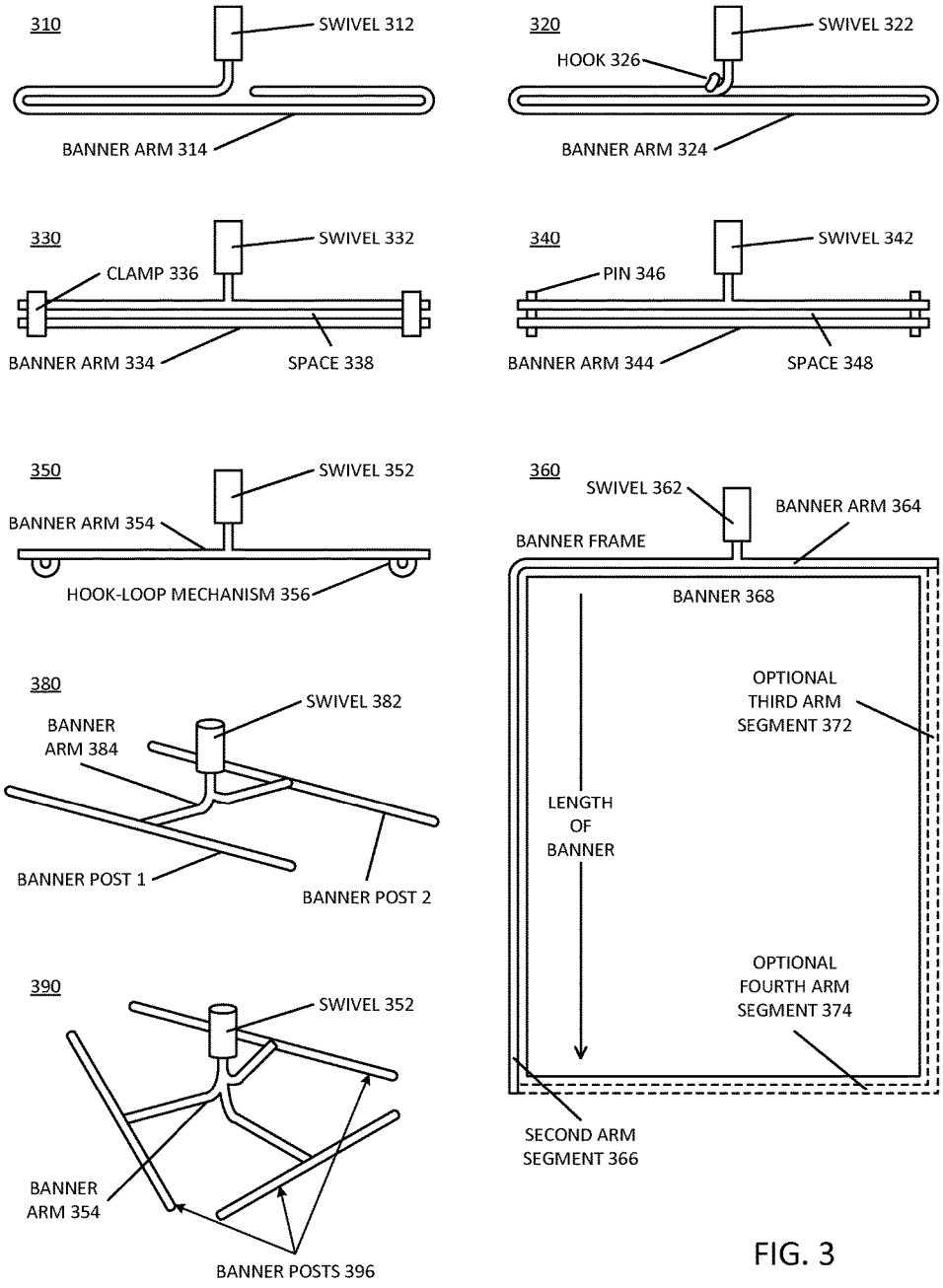
FIG. 3 is a representation of embodiments of a banner arm that holds a banner for display.

FIG. 3 is a representation of embodiments of a banner arm that holds a banner for display. The various embodiments illustrated provide non-limiting examples of banner arms for use with swivel heads in accordance with any embodiment described herein. Each banner arm embodiment illustrates a respective swivel, which represents a swivel head mechanism in accordance with any embodiment described herein. In general, the illustrated swivels enable the banner arms to freely rotate 360 degrees about an axis to provide a rotating banner display system. In general, in one embodiment, at least a portion of a banner arm has a sloped or angled portion. In one embodiment, the banner arm holds a banner straight across along at least one edge of the banner. In one embodiment, the banner arm includes straight portions that include a rigid portion to which the banner can attach. The banner arms can connect to the swivel heads in accordance with any embodiment described herein, which may be a connection to an axle that connects with the swivel. Thus, each swivel shown can include a swivel head and an axle, in accordance with one embodiment of a swivel system. Additionally, in accordance with such embodiments, the end of the banner arm can be the axle. In one embodiment, each banner arm can be made of any rigid or semi-rigid material that can hold its shape to hold and display a banner. The banner arms can be made of metal, wood, resin, plastic, and/or other material.

In one embodiment, system 310 includes swivel 312 and includes banner arm 314. Banner arm 314 is one example of a "coat hanger" shape, which extends out from a connection point with swivel 312, and bends around to a rigid portion that will hold a banner. Many banners include a sleeve that can be placed over a rod. Banner arm 314 can include a rod to hold the banner via such a sleeve. In one embodiment, the end of banner arm 314 curves up from the rod portion and bends back around towards the axle that connects to swivel 312. In one embodiment, the end of banner arm 314 actually extends all the way back to the axle portion under swivel 312 and can hook around the axle. Consider system 320 with swivel 322 and banner arm 324. System 320 can be in accordance with system 310, and also represent a coat hanger banner arm. In one embodiment, system 320 includes hook or latching portion 326 to connect back around to the top portion of banner arm 324 or an axle. Either version of the coat hanger banner arm (i.e., system 310 or system 320) can prevent the banner from sliding off the rod portion while it spins.

In one embodiment, the banner arm system includes a dual-rod configuration, such as illustrated by system 330 and system 340. In one embodiment, in system 330, swivel 332 connects to banner arm 334, which is a dual rod banner arm. Banner arm 334 can include one rod that connects to swivel 332 and a separate rod that holds the banner. There is a space 338 between the two rods. Similarly, in system 340, in one embodiment, swivel 342 connects to one rod of banner arm 344, and a second rod holds the banner. There is a space 348 between the two rods. The spacing 338 and 348 can be a minimal amount of space between the two rods to allow room for the banner to attach to the rod of the banner arm. In one embodiment, the space is merely the separation between the rods when a banner is mounted, and the rods can touch or come close to touching in one embodiment.

The rod that holds the banner can be attached to the rod that attaches to the swivel by a clamp, a pin, a screw, or other mechanism. As illustrated, banner arm 334 includes clamps 336 to secure one rod to the other. As illustrated, banner arm 344 includes pins 346 to secure one rod to the other. In one embodiment, the dual-rod configuration such as in system 330 and/or 340 can be combined with the coat hanger design such as in system 310 and/or system 320.

In one embodiment, system 350 illustrates a banner arm with a portion that attaches to the swivel and includes multiple hook-loop mechanisms. System 350 includes swivel 352, which connects to banner arm 354. In one embodiment, banner arm 354 includes at least two hook-loop mechanisms 356. Use of at least two hook-loop mechanisms 356 can allow the banner to hang straight from banner arm 354. The hook-loop interface can allow the use of a hooking style interface to the banner. The hook or loop attached to the banner can be attached via rivet or other mechanism to secure the hook or loop directly to an edge of banner arm 354. The hook or loop could alternatively be attached to an edge of banner 354 via clamps or alligator clips or another removable mechanism. In one embodiment, the hook and loop mechanisms 356 can be simple rod portions bent into loops and/or curved hooks. In one embodiment, mechanisms 356 are bent hooks that are spaced to connect to corresponding loops that are built into a flag.

In one embodiment, system 360 illustrates a banner frame system. System 360 includes swivel 362 connected to banner arm 364. Banner arm 364 can be a banner frame which attaches to multiple edges of banner 368. Thus, banner arm 364 can include a rod portion that connects directly to swivel 362, and one or more arm segments that extend away from the portion that attaches to swivel 362. For example, system 360 illustrates a second arm segment 366 extending vertically away from swivel 362. System 360 also illustrates optional third arm segment 372 and optional fourth arm segment 374. Segment 372 extends vertically away from swivel 362, and segment 374 would attach to an edge of banner 368 that is farthest from swivel 362 and parallel to the ground. Segments 366 and 372 can be considered vertical portions, and segment 374 can be considered a base portion. It will be understood that system 360 specifically illustrates a frame system for a rectangular banner 368, but could be modified for a banner of any shape.

In one embodiment, with reference to a frame, it will be understood that one of the primary applications of a frame system is to display the banner without a significant amount of swaying or with minimal or no swaying. While such a display may be desired, traditionally such a display would make the banner completely stationary. With a frame system, such as described, in one embodiment, the banner can be fully displayed in fixed fashion, while still allowing rotation about a vertical axis. In one example, consider a banner with words or a message, where such a fixing of the banner itself may be preferred, while still allowing the visual interest of movement. Other examples are possible. In one embodiment, a similar effect can be achieved by attaching a banner to any embodiment of a banner arm described, and including a rod at the bottom of the banner (which can be attached via some form of securing and/or could be included in a sleeve that can be provided in the banner). Thus, the display system will provide for less twisting and waving of the banner, while allowing the banner to spin.

In one embodiment, the banner arm can include multiple arms to display multiple banners simultaneously, such as with systems 380 and 390. As shown, a banner arm can include two (such as in system 380), three (such as in system 390), or more banner posts that all attach to the same swivel. For example, system 380 includes swivel 382 that attaches to banner arm 384 with separate posts 1 and 2 for two different banners to display simultaneously. System 390 includes swivel 392 that attaches to banner arm 384 with three separate banner posts 396. Each swivel, banner arm, and banner post can be in accordance with any embodiment described herein, and the illustrations are simplified for purposes of description. Thus, a swivel can rotate with respect to a mounting arm, and spin multiple banners or flags around a common axis of rotation. It will be understood that a confirmation with multiple posts can include banner arms of any configuration, such as any of those described above. The separate banner posts can be opposite each other, symmetrically placed around an axis of rotation, asymmetrically placed around an axis of rotation, in a line (e.g., multiple flags one next to the other), in a semicircle or arc, or any other configuration.

Figure 4:
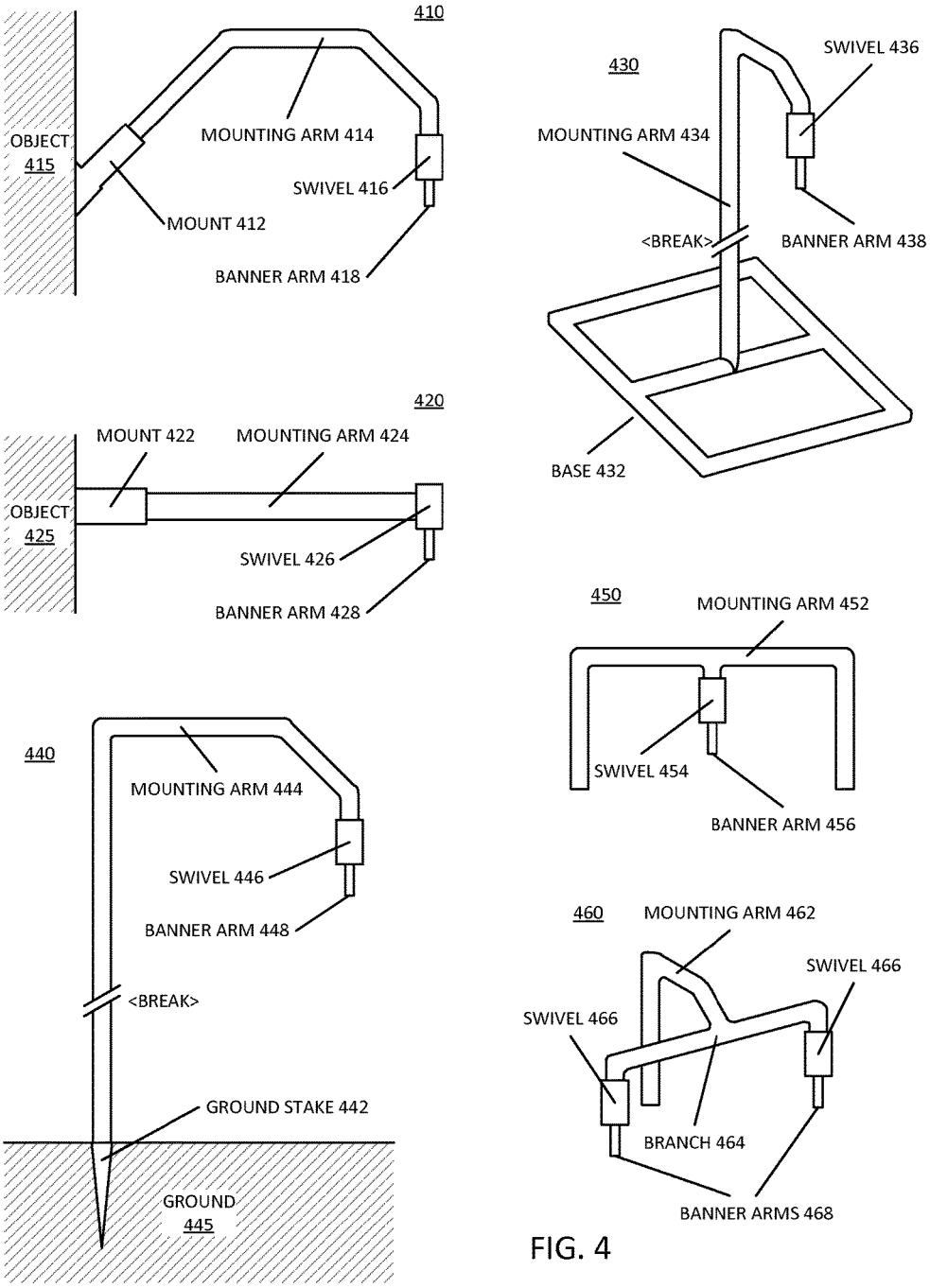
FIG. 4 is a representation of embodiments of a mounting arm.

FIG. 4 is a representation of embodiments of a mounting arm. The mounting arms can be in accordance with any mounting arm described herein. The mounting arms illustrated can be used in conjunction with any compatible configuration of swivel head and/or banner arm described herein. In one embodiment, each mounting arm can be made of any rigid or semi-rigid material that can hold its shape to hold and display a banner. The mounting arms can be made of metal, wood, resin, plastic, and/or other material. Embodiments of a mounting arm can affix to a mount, which can be a bracket, hole, or other holder that can receive the mounting arm and allow it to display from the object of interest.

In one embodiment, system 410 illustrates mounting arm 414 that attaches to mount 412 that is attached to object 415 at an angle. The angle can be any angle. System 410 illustrates mounting arm 414 with multiple bends or portions extending at different angles from each other. System 420 illustrates mounting arm 424 that attaches to mount 422 that is attached to object 425 not at an angle (it extends horizontally or orthogonally out from object 425). The mounting arm can have no bends in it, or can have any number of bends. Each mounting arm 414 and 424 mount to respective swivel heads 416 and 426 to allow the swivel head to provide a rotational axis that is perpendicular or substantially perpendicular to the ground, whatever the angle of mounting and whatever bends may be in the mounting arm. Such a configuration allows a banner to hang from a respective banner arm (banner arm 418 for system 410 and 428 for system 420) attached to the swivel. In one embodiment, a swivel 416 and/or 426 mounts to or is a portion of a mounting arm on a side that is orthogonal to the rotational axis of the banner arm provided by the swivel head.

System 430 illustrates one embodiment in which a mounting arm system is or includes or attaches to a free-standing base. System 430 includes base 432, which can be rectangular or any other shape. Base 432 should have a footprint that is large enough to support display of a banner. System 430 includes mounting arm 434 that extends from base 432, and which can connect to swivel 436. Banner arm 438 extends down from swivel 436 to display one or more banners. In one embodiment, mounting arm 434 curves out from base 432 or starts on one edge of base 432 (instead of from the middle) to allow the rotational axis around which banner arm 438 will swivel to pass somewhere near the center of the base.

System 440 illustrates one embodiment in which the mounting system is or includes or attaches to a spike or stake or other mechanism that allows the display system to be driven into the ground. In one embodiment, system 440 includes ground stake 442 to drive into ground 445 to hold mounting arm 444. Ground stake 442 can be a spike or stake with a single point or be multi-pointed. Thus, mounting arm 444 can stand directly in ground 445, and allow swivel 446 and banner arm 448 to attach to a banner and allow the banner to swivel.

System 450 illustrates one embodiment in which the mounting system where the mounting arm can include a loop-like shape. Mounting arm 452 can have a loop, which can allow connection to multiple mounts or stakes or bases, and provide a more stable fixture. In one embodiment, swivel 454 can attach somewhere under a top edge or top loop of mounting arm 452. Banner arm 456 can then extend out from swivel 454 to hang a banner.

System 460 illustrates one embodiment in which the mounting arm system includes multiple arms that each extend out to a separate swivel head. In one embodiment, system 460 includes a single mounting arm 462, which can attach to a base or a stake system or a mount. Mounting arm 462 can attach to multiple swivels 466, and allow the display of multiple different banners simultaneously. Each swivel 466 can be attached at one end to the same mounting arm 462 and at the other end to any banner arm 468 described herein. Thus, a display system can include a multi-arm mounting arm 462, which branches at branch 464 to connect multiple portions to separate swivel heads 466 that can each connect to a banner arm 468 having one or more posts to which to connect a banner. Thus, the multi-arm mounting system 460 can provide multiple parallel rotational axes.

Figure 5:
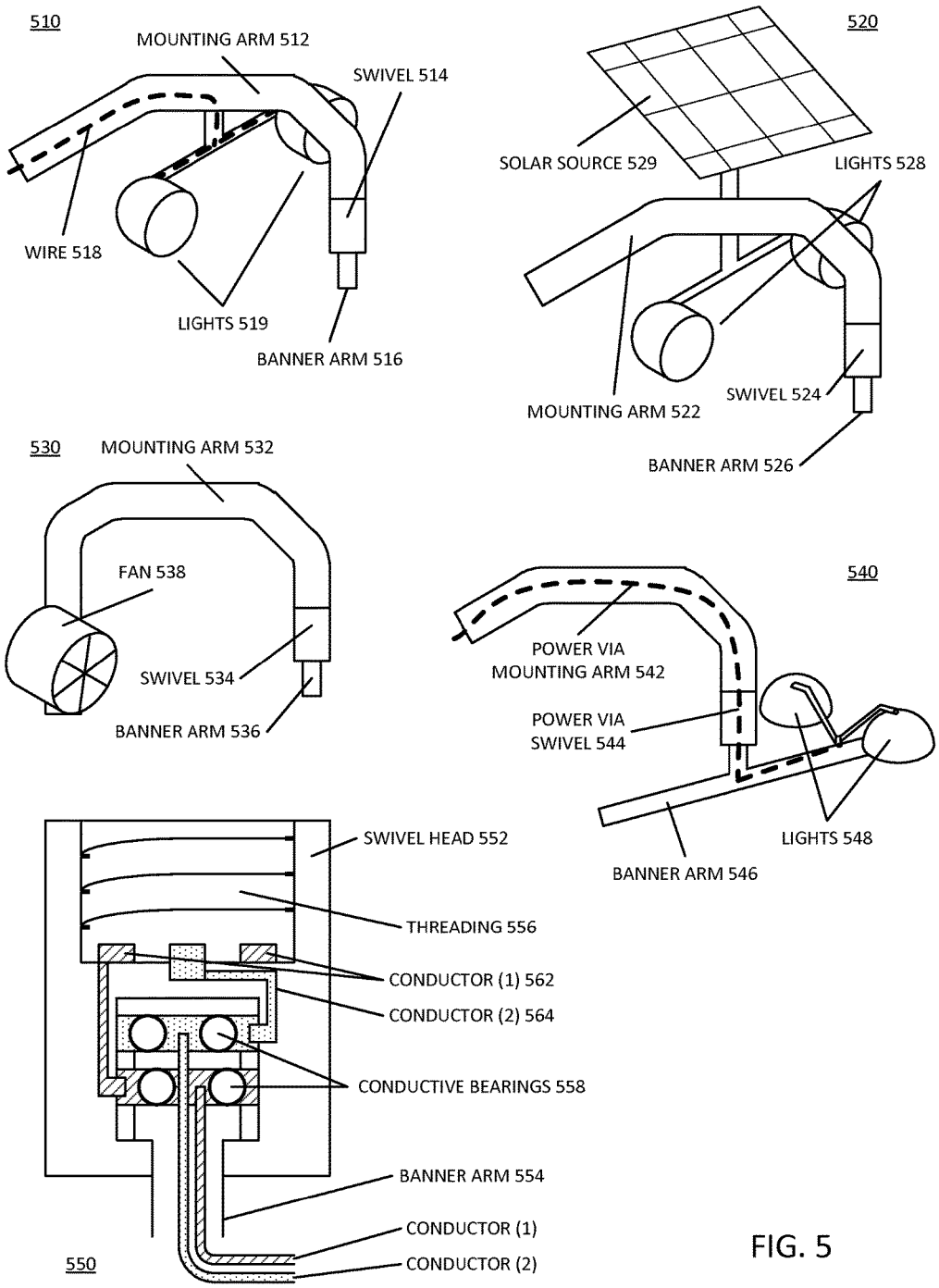
FIG. 5 includes representations of embodiments of accessories that can be included with a swivel banner display.

FIG. 5 includes representations of embodiments of accessories that can be included with a swivel banner display. Any embodiment of a display system described herein with mounting arm, swivel head, and banner arm can be configured to include one or more accessories. While different accessories are illustrated, it will be understood that accessories can be combined, and other accessories can be included that are in the same spirit of those illustrated. Thus, the accessory systems illustrated are for purposes of example, and are non-limiting.

System 510 illustrates one embodiment of a display system in which mounting arm 512 includes attached lighting 519 that can shine on the banner. Lighting 519 can include standard lighting, or any type of theatrical or performance lighting system. In one embodiment, the lights can be battery powered. In one embodiment, mounting arm 512 can include one or more wires 518 that extend through the mounting arm or along the inside or outside of mounting arm 512 to lights 519. Such wires 518 can provide electrical connection to a battery and/or AC (alternating current) source (not shown). Swivel 514 and banner arm 516 can be in accordance with any embodiment described herein to hold a banner for display.

System 520 illustrates one embodiment of a display system that can include or can connect to solar panel or solar source 529 that can charge a battery and/or power lights 528. In one embodiment, one or more solar panels 529 can be mounted directly onto mounting arm 522. Mounting arm 522 connects to swivel 524, which in turn connects to banner arm 526, in accordance with any embodiment described herein.

System 530 illustrates one embodiment in which a display system includes a fan. In one embodiment, mounting arm 532 can include an attachment for fan 538, or can include a fan or other airflow-control mechanism to cause banner arm 536 to rotate about the rotational axis provided by swivel 534. In one embodiment, fan 538 can be included in a base connected to mounting arm 532. The power to fan 538 can include any of the forms of power described above with respect to lighting. In one embodiment, other types of electrical attachments can be included to mounting arm 532.

System 540 illustrates one embodiment of a display system in which mounting arm 542 can include one or more power cords that run through mounting arm 542 or along the mounting arm to a portion that connects to swivel 544. In one embodiment, swivel 544 includes a swivel head that provides a power pass-through to banner arm 546. Thus, the display system can include lights and/or other accessories attached to banner arm 546, which are powered by a power source that provides power via mounting arm 542 and swivel 544. The power can thus be provided by an electrical outlet or battery system that does not have to attach to the banner arm.

One possible example of a swivel that allows power to pass through is illustrated in cross-section 550. In one embodiment, the powered swivel head 552 includes a dual ball-bearing system, where each ball bearing ring includes conductive ball bearings 558. In addition to conductive ball bearings 558, the ball bearings can be lubricated with a conductive lubricant. The entire center portion of swivel head 552 that extends out to banner arm 554 can spin freely by ball bearings 558. The ball bearings can hold up banner arm 554, or the system can include another mechanism (such as an axle cap system) that can support banner arm 554, and ball bearings 558 of the dual ball bearing rings can simply provide power.

In one embodiment, swivel head 552 includes two conductors, which can include a metallic or conducting contact and a metallic or conducting ring, or concentric conducting rings. The drawing illustrates a contact in the center of the threading hole as first conductor 562, and a conductive ring that surrounds it as second conductor 564. Such contacts within swivel head 552 can connect to corresponding fixed contacts on an end of a mounting arm (not shown). Threading 556 can connect the mounting arm to swivel head 552 and connect the separate contacts.

In one embodiment, the electrical pass-through enables the passing of high voltage (e.g., 120 V AC), where one contact will be "hot" (passing the voltage) and the other will be neutral. However, with AC connections, the conductors can typically be swapped, as orientation of the voltage and neutral typically does not matter. In one embodiment, the electrical pass-through enables the passing of low voltage (e.g., 12 V DC, 5 V DC, or other voltage). In such a scenario, one conductor can carry the DC voltage, and the other will be neutral. For DC the orientation usually matters, and the positive and negative (or neutral) terminals can be labeled. In a scenario where low voltage is used, there can be AC to DC conversion on the stationary side of the mounting system (e.g., connected to the mounting arm). Thus, high voltage can be converted to low voltage to pass through the swivel head, in one embodiment.

As illustrated, first conductor 562 and second conductor 564 are fixed, and include fixed wires or metal portions that extend down to an outer conductive shell of the ball bearings, one conductor connected to one ball bearing ring. The inner portion of the swivel head also includes a conductive inner shell of the ball bearings, and each electrically interfaces to a separate conductor via the conductive ball bearings. Thus, the inner portion of swivel head 552 can include fixed electrical wires or metallic posts that can extend through and/or along banner arm 554 to a light or other electrically-powered accessory. It will be understood that because the wires or conductive paths along the banner arm are attached at fixed locations to the inner shell of the ball bearing rings, they will spin and maintain their fixed relative position within swivel head 552 and maintain a fixed relative position with respect to banner arm 554. Thus, the wires will not "twist" and prevent the 360 degrees of rotational freedom of the banner arm with respect to mounting arm 554. Similarly, the same could be said of the conductive paths from the contacts that connect from mounting arm 554 to the outer shell of the ball bearing rings, again allowing rotational freedom of the banner arm. Electricity can conduct along the entire circuit through the ball bearings between the inner and outer shells, thus completing the electrical circuit.

In one embodiment, the electrical pass-through capability of swivel head 552 can allow the inclusion of light emitting items or fiber optics or other display items. In one embodiment, the banner for display could include a fiber optic web woven together and hanging from banner arm 554, which can include an outlet or other connection to power via swivel head 552. The banner for display could alternatively be or include fiber optics woven between different arms of a frame configuration banner arm. There are any number of possible rotating displays that are too numerous to mention, but are encompassed by the scope of what is described, as will be understood by those skilled in the art.

Figure 6A:
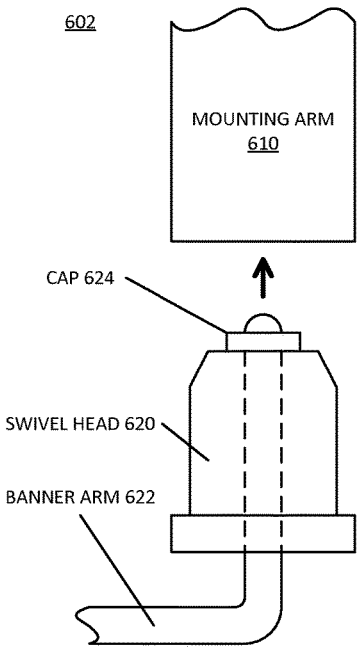
FIG. 6A is a representation of an embodiment of a swivel head that mounts in the end of a hollow mounting arm.

FIG. 6A is a representation of an embodiment of a swivel head that mounts in the end of a hollow mounting arm. System 602 represents an embodiment of a mounting system for a banner display system in accordance with any compatible embodiment described herein. Certain embodiments of a swivel head may not be compatible what is illustrated in system 602. In one embodiment, mounting arm 610 includes an end portion that is hollow or has a hole into which swivel head 620 can be inserted. The sizing of swivel head 620 can be made to match an inner diameter of mounting arm 610 to allow a snug fit. In one embodiment, mounting arm 610 can expand to receive swivel head 620, and then be contracted by latches, straps, or other mechanisms, or by shape memory of the material of the end of the mounting arm.

In one embodiment, swivel head 620 includes a piece with a hole or via through a center, and banner arm 622 extends through the swivel head. A vertical portion of banner arm 622 (vertical with reference to when banner arm holds a banner for display) extends from one end of swivel head 620 to the other end, and is secured by cap 624. Cap 624 can be replaced with a bolt or other securing mechanism, and/or can be welded or otherwise machined onto the end of the swivel arm. In one embodiment, cap 624 includes a washer to hold the banner arm and allow easier swiveling movement of banner arm 622.

Figure 6B:
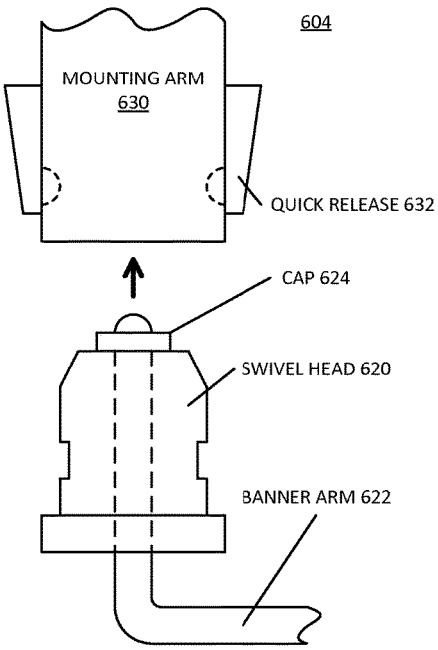
FIG. 6B is a representation of an embodiment of a swivel head that mounts in the end of a hollow mounting arm with a quick release.

FIG. 6B is a representation of an embodiment of a swivel head that mounts in the end of a hollow mounting arm with a quick release. System 604 represents an embodiment of a mounting system for a banner display system in accordance with any compatible embodiment described herein. Certain embodiments of a swivel head may not be compatible what is illustrated in system 604. In one embodiment, mounting arm 630 includes an end portion that is hollow or has a hole into which swivel head 640 can be inserted. The sizing of swivel head 640 can be made to match an inner diameter of mounting arm 630 to allow a snug fit.

In one embodiment, mounting arm 630 includes a quick release mechanism 632 to detachably attach swivel head 640. Quick release 632 can include a lever and ball or lever and stub mechanism, where a ball or stub can be included on a button acting as a lever. When a top of the button is depressed, it withdraws the bottom portion including the ball or stub. Swivel head 640 can include a mating mechanism for quick release 623 (not specifically shown in system 604). Other quick release mechanisms could be used to allow swivel head 640 to be inserted into the end of mounting arm 630 can be removably attachable without the need for tools. Any quick release mechanism 632 does not require an external tool to detach the swivel head.

In one embodiment, swivel head 640 includes a piece with a hole or via through a center, and banner arm 642 extends through the swivel head. A vertical portion of banner arm 642 (vertical with reference to when banner arm holds a banner for display) extends from one end of swivel head 640 to the other end, and is secured by cap 644. Cap 644 can be replaced with a bolt or other securing mechanism, and/or can be welded or otherwise machined onto the end of the swivel arm. In one embodiment, cap 644 includes a washer to hold the banner arm and allow easier swiveling movement of banner arm 642.

In one embodiment, any embodiment of system 602 and/or system 604 can enable the swivel head to be inserted and remove from the respective mounting arm. In one embodiment, the swivel head is permanently attached to the banner arm or attached securely and would require the use of tools to separate the banner arm from the swivel head. With a secure fixture to the banner arm, the entire banner, banner arm, and swivel head can be easily installed to and removed from a mounting arm. Thus, for example, the banner could be displayed throughout the day and removed at night, without the difficulty of having to take down an entire pole or mounting arm. Additionally, the banner could be easily switched between different types of mounting arms that can be attached to different bases or mounts.

Figure 7A:
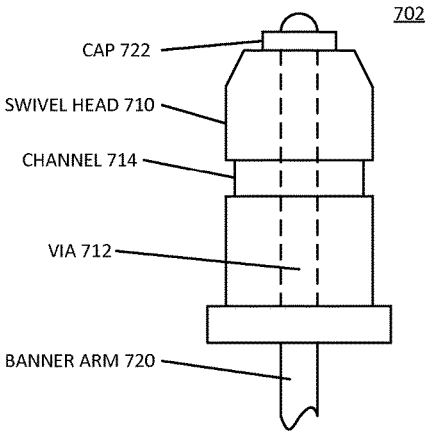
FIG. 7A is a representation of an embodiment of a swivel head with a channel around the swivel head.

FIG. 7A is a representation of an embodiment of a swivel head with a channel around the swivel head. System 702 represents one embodiment of a swivel interface for a banner display system. Swivel head 710 can be a swivel head for a swivel interface in accordance with any compatible embodiment described herein. In one embodiment, swivel head 710 includes via 712 or hole through the body of the swivel head. Via 712 or a hole through the swivel could alternatively be referred to as a channel through swivel head 710, but to avoid confusion with the channel gap 714 on the outside of the body of swivel head 710, it will not be referred to as a channel.

In one embodiment, system 702 includes banner arm 720 that extends through swivel head 710 as a spinning axle, secured by cap 722. In one embodiment, swivel head 710 includes channel 714 in the outer body of the swivel head. For example, channel 714 can radially circle swivel head 710, and have a small depth difference from the outside of swivel head 710. The depth can be on the order of millimeters or partial millimeters. The depth of the channel can depend on what the channel will be used for. For example, channel 714 can provide a location where a quick release mechanism can connect to the swivel head. In one embodiment, instead of a channel extending radially all the way around swivel head 710, the channel can include channel portions or simply holes or depressions.

Figure 7B:
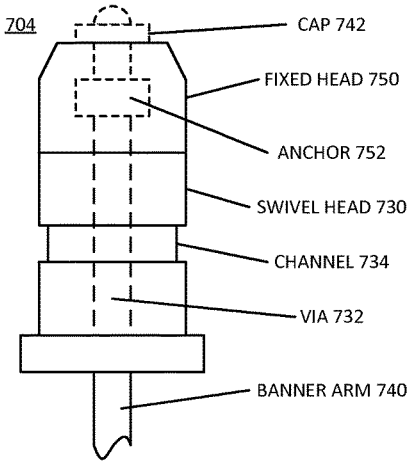
FIG. 7B is a representation of an embodiment of a swivel head having a fixed portion and a swivel portion.

FIG. 7B is a representation of an embodiment of a swivel head having a fixed portion and a swivel portion. System 704 represents one embodiment of a swivel interface for a banner display system, and can be an extension of or an alternative to system 702 of FIG. 7A. Swivel head 730 can be a swivel head for a swivel interface in accordance with any compatible embodiment described herein. In one embodiment, swivel head 730 includes via 732 or hole through the body of the swivel head. In one embodiment, system 704 includes banner arm 740 that passes through via 732 of swivel head 730. In one embodiment, swivel head 730 includes channel 734, which can be a channel in accordance with channel 714 of system 702. In one embodiment, system 704 includes cap 742 securing banner arm 740.

In one embodiment, system 704 includes swivel head 730 that is a swiveling portion that can spin 360 degrees around, and fixed head 750 that does not move. In one embodiment, fixed head 750 can be secured into a mounting arm, and allow swivel head 730 to swivel with respect to fixed head 750. System 804 can include components in accordance with an embodiment of system 804 described below. In one embodiment, fixed head 750 includes anchor 752 within the fixed portion. Anchor 752 can be an anchor for banner arm 840. When system 704 includes anchor 752, cap 742 can be eliminated.

In one embodiment, system 702 and/or system 704 can be used to provide a retrofit solution to an existing flagpole. For example, an embodiment of a swivel head can be attached to an existing flagpole to provide a system in which a banner arm can swivel freely in 360 degrees with respect to a flagpole and flagpole mount. In such a retrofit scenario, any compatible embodiment of a swivel head can be used. The swivel head can be coupled to an existing straight pole and/or to an existing shepherd hook style pole (i.e., one that curves). In one embodiment, a mating coupler can be used to allow the swivel head to fit onto the existing pole. For example, a coupler can adjust an angle to allow a swivel head to hang vertically down. Consider, for example, a traditional flagpole that extends from a mount at 30 degrees up from parallel to the ground. In such an example a coupler can attach to the end of the flagpole and bend around to allow a swivel head to be inserted or otherwise attached. Thus, a banner arm can be hung from the swivel head and allow the mounting of a banner that has a free range of spinning motion with respect to the flagpole. It will be understood that other implementations can also be made in similar fashion to allow the retrofitting of a swivel head to an existing flagpole, and the descriptions are not limiting.

Figure 8A:
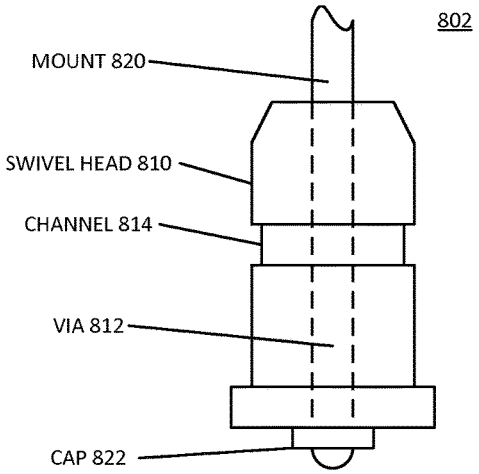
FIG. 8A is a representation of an embodiment of a swivel head with a channel around the swivel head that enables simplified mounting.

FIG. 8A is a representation of an embodiment of a swivel head with a channel around the swivel head that enables simplified mounting. System 802 represents one embodiment of a swivel interface for a banner display system. Swivel head 810 can be a swivel head for a swivel interface in accordance with any compatible embodiment described herein. In one embodiment, swivel head 810 includes via 812 or hole through the body of the swivel head. In one embodiment, system 802 includes mount 820 that passes through via 812 of swivel head 810. In one embodiment, swivel head 810 includes channel 814, which can be a channel in accordance with channel 714 of system 702. In one embodiment, system 802 includes cap 822 securing mount 820.

It will be observed that system 802 is similar to system 702 of FIG. 7, but whereas system 702 has a banner arm that extends through the swivel head to be capped at the "top" of the swivel head, system 802 has mount 820 that extends through swivel head 810 to be capped at the "bottom" of the swivel head. It will be understood that top and bottom are relative terms, but refer here to the fact that both drawings illustrate the same orientation of similar components. In one embodiment, system 802 enables the use of a mount that can directly connect to a house beam or overhang, or connect to a bottom of some other structure from which a banner can be hung for display. Thus, mount 820 can include a wire or metal rod attached to or ending in a screw or other mechanism to allow it to mount to a structure.

Figure 8B:
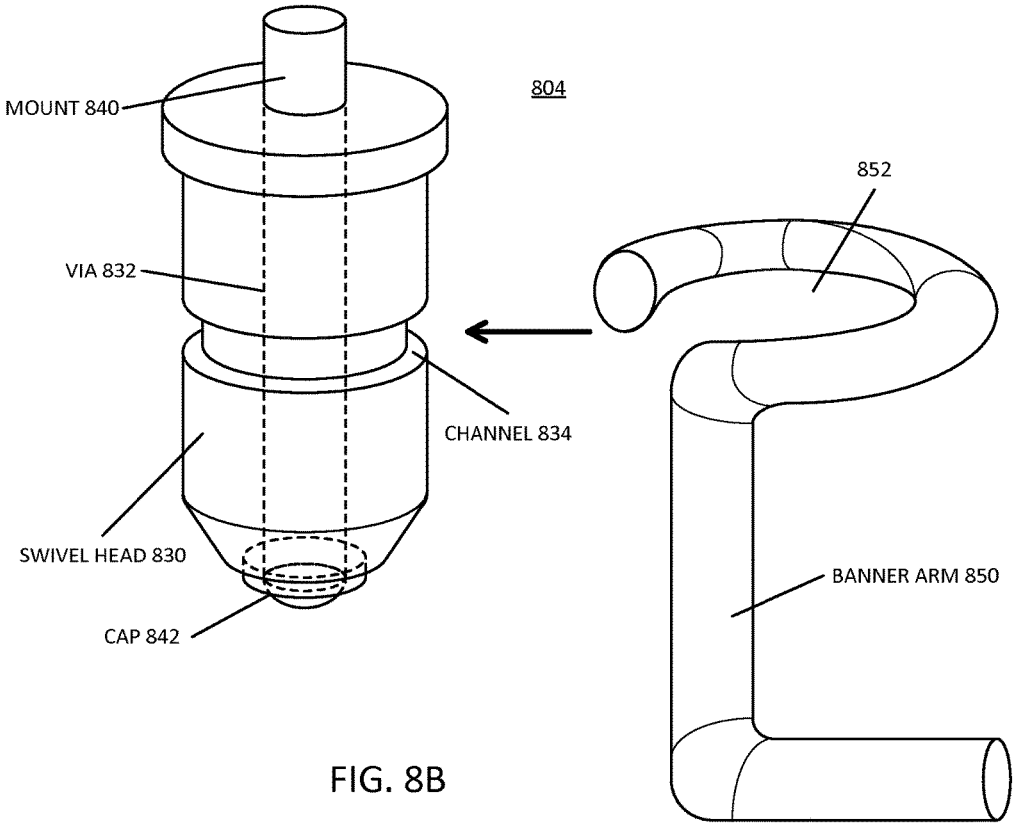
FIG. 8B is a representation of an embodiment of a swivel head with a channel to receive a banner arm.

FIG. 8B is a representation of an embodiment of a swivel head with a channel to receive a banner arm. System 804 represents one embodiment of a swivel interface for a banner display system. Swivel head 830 can be a swivel head for a swivel interface in accordance with any compatible embodiment described herein. In one embodiment, swivel head 830 includes via 832 or hole through the body of the swivel head. In one embodiment, system 804 includes mount 840 that passes through via 832 of swivel head 830. In one embodiment, swivel head 830 includes channel 834, which can be a channel in accordance with channel 714 of system 702. In one embodiment, system 804 includes cap 842 securing mount 840. In one embodiment, mount 840 can be in accordance with any embodiment of mount 820.

In one embodiment, system 804 includes banner arm 850 that interfaces with and mounts to swivel head 830. In one embodiment, banner arm 850 includes hook 852 or some other mechanism to secure to channel 834 of swivel head 830. For example, if banner arm 850 is made of a material that has some ability to bend and return to its original shape, hook 852 can be a loop in a top end of banner arm 850. Hook 852 can loop around channel 854 and secure the banner arm to the swivel head. Where swivel head 830 swivels freely with respect to mount 840, securing banner arm 850 to swivel head 830 via hook 852 can enable a secure connection of the banner arm to the swivel head and allow the banner arm to swivel freely around with respect to mount 840.

Figure 9A:
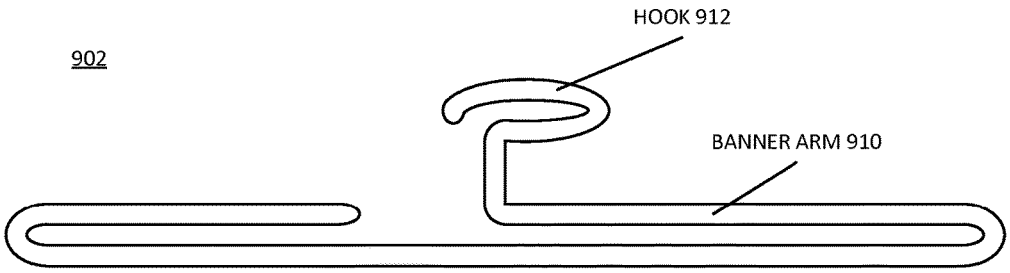
FIG. 9A is a representation of an embodiment of a banner arm with a hook that mounts to a swivel head with a channel.

FIG. 9A is a representation of an embodiment of a banner arm with a hook that mounts to a swivel head with a channel. Banner mount system 902 represents one embodiment of a banner arm in accordance with any embodiment where a swivel head includes a portion that swivels freely with respect to a mount or mounting arm (such as system 704, system 802, system 804, or a comparable system). In one embodiment, system 902 includes banner arm 910, which has a top portion with hook 912. Hook 912 can be a loop or open circle portion that will secure onto a corresponding swivel head. Hook 912 can include an inner diameter that allows it to fit securely onto a swivel head. While banner arm 910 is illustrated as an open coat hanger type banner arm, banner arm 910 can be in accordance with any embodiment of a banner arm.

Figure 9B:
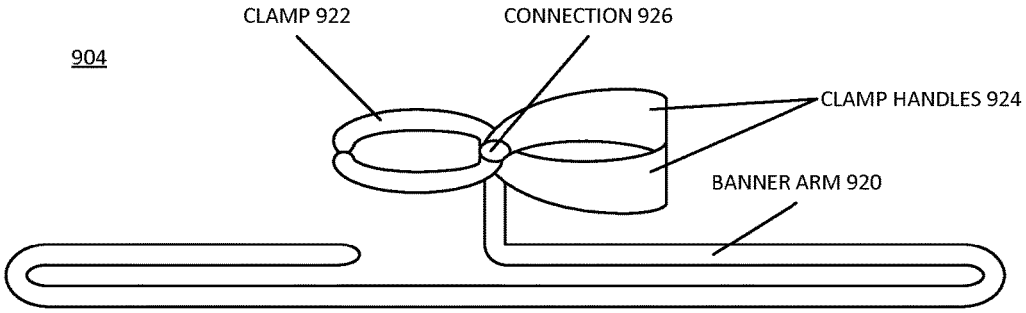
FIG. 9B is a representation of an embodiment of a banner arm with a clamp that mounts to a swivel head with a channel.

FIG. 9B is a representation of an embodiment of a banner arm with a clamp that mounts to a swivel head with a channel. Banner mount system 904 represents one embodiment of a banner arm in accordance with any embodiment where a swivel head includes a portion that swivels freely with respect to a mount or mounting arm (such as system 704, system 802, system 804, or a comparable system). In one embodiment, system 904 includes banner arm 920, which has a top portion with clamp 922. Clamp 922 can include a loop or circular portion that opens up, and can spring back to secure onto a corresponding swivel head (where the spring mechanism defaulting the clamp closed is not specifically shown). Clamp 922 can include an inner diameter that allows it to fit securely onto a swivel head. While banner arm 920 is illustrated as an open coat hanger type banner arm, banner arm 920 can be in accordance with any embodiment of a banner arm. In one embodiment, clamp 922 includes connection 926 to secure the clamp to banner arm 920. Clamp 922 includes clamp handles 924, which allow a user to squeeze or otherwise depress the handles to open and close clamp 922.

In one aspect, an apparatus includes: a banner arm including a rigid portion to hold an edge of a banner, the rigid portion holding the edge of the banner to cause the banner to hang vertically from the banner arm; and a swivel head to connect to the banner arm and mount to a mounting arm, the swivel head to allow the banner arm to rotate in 360 radial degrees about a rotational axis, the rotational axis being perpendicular to a line of the rigid portion of the banner arm, and the rotational axis extending from a center of the swivel head where the swivel head connects to the banner arm.

In one aspect, an apparatus includes: a banner arm including a rigid portion to hold an edge of a banner, the rigid portion holding the edge of the banner to cause the banner to hang from the banner arm; a mounting arm to mount the banner to an object for display; and a swivel head to connect the banner arm to the mounting arm, the swivel head to allow the banner arm to rotate in 360 radial degrees about a rotational axis while mounted to the mounting arm, the rotational axis being perpendicular to a line of the rigid portion of the banner arm, and the rotational axis extending from a point where the swivel head connects to the banner arm.

In one aspect, a banner display system includes: banner holding means for holding an edge of a banner, to cause the banner to hang from the banner holding means; mounting means for mounting the banner to an object for display; and swivel means for connecting allowing the banner holding means and the banner to rotate freely about a rotational axis with respect to the mounting means, the rotational axis being perpendicular to a line of the rigid portion of the banner holding means, and the rotational axis extending from a point where the swivel means connects to the banner holding means.

With respect to the various aspects presented above, various embodiments can be applied to any one of them. In one embodiment, the banner comprises a flag. In one embodiment, the swivel head is removably connected to the banner arm. In one embodiment, the swivel head is removably mounted to the mounting arm. In one embodiment, the swivel head further includes an axle and an axle cap. In one embodiment, the swivel head further includes a ball bearing to allow the banner arm to rotate. In one embodiment, the swivel head further includes an electrical pass-through mechanism to provide power from the mounting arm to the banner arm. In one embodiment, the banner arm includes multiple banner mounts. In embodiment, the swivel head includes a channel in the outside of the swivel head body. In one embodiment, a banner arm includes a hook to couple to a channel in the outside of the swivel head body. In one embodiment, the swivel head includes a rigid portion and a portion that rotates. In one embodiment, the swivel head mounts into a hollow portion of the mounting arm. In one embodiment, the mounting arm comprises a wire that extends through a via of the swivel head. In one embodiment, the mounting arm and/or the swivel head include a quick release.

Besides what is described herein, various modifications can be made to the disclosed embodiments and implementations of the invention without departing from their scope. Therefore, the illustrations and examples herein should be construed in an illustrative, and not a restrictive sense. The scope of the invention should be measured solely by reference to the claims that follow.

What is claimed is:

1. An apparatus comprising:

a banner arm separate from a non-rigid banner to be displayed and configured to receive an exchangeable banner, the banner arm including a rigid portion on which to mount a single edge of the banner, the rigid portion to hold the edge of the banner to cause the banner to hang vertically from the banner arm and to leave an unmounted edge of the banner free to wave in response to moving air; and a swivel head to connect to the banner arm and mount to a mounting arm, the swivel head to allow the banner arm to rotate in 360 radial degrees about a rotational axis and to allow the unmounted edge of the banner to wave separate from the rotation of the banner arm, the rotational axis being perpendicular to a line of the rigid portion of the banner arm, and the rotational axis extending from a center of the swivel head where the swivel head connects to the banner arm.

2. The apparatus of claim 1, wherein the banner comprises a flag.

3. The apparatus of claim 1, wherein the swivel head is removably connected to the banner arm.

4. The apparatus of claim 1, wherein the swivel head is removably mounted to the mounting arm.

5. The apparatus of claim 1, wherein the swivel head further includes an axle and axle an cap.

6. The apparatus of claim 1, wherein the swivel head further includes a ball bearing to allow the banner arm to rotate.

7. An apparatus comprising:

a banner arm separate from a non-rigid banner to be displayed and configured to receive an exchangeable banner, the banner arm including a rigid portion on which to mount a single edge of the banner, the rigid portion to hold the edge of the banner to cause the banner to hang from the banner arm and to leave an unmounted edge of the banner free to wave in response to moving air;

a mounting arm to mount the banner to an object for display; and a swivel head to connect the banner arm to the mounting arm, the swivel head to allow the banner arm to rotate in 360 radial degrees about a rotational axis while mounted to the mounting arm and to allow the unmounted edge of the banner to wave separate from the rotation of the banner arm, the rotational axis being perpendicular to a line of the rigid portion of the banner arm, and the rotational axis extending from a point where the swivel head connects to the banner arm.

8. The apparatus of claim 7, wherein the banner comprises a flag.

9. The apparatus of claim 7, wherein the swivel head is removably connected to the banner arm.

10. The apparatus of claim 7, wherein the swivel head is removably mounted to the mounting arm.

11. The apparatus of claim 7, wherein the swivel head further includes an axle and an axle cap.

12. The apparatus of claim 7, wherein the swivel head further includes a ball bearing to allow the banner arm to rotate.

13. The apparatus of claim 7, wherein the swivel head further includes an electrical pass-through mechanism to provide power from the mounting arm to the banner arm.

14. A banner display system, comprising:

banner holding means for holding a single edge of a non-rigid banner, to cause the banner to hang from the banner holding means, the banner holding means being separate from the banner;

mounting means for mounting the banner to an object for display; and swivel means for connecting allowing the banner holding means and the banner to rotate freely about a rotational axis with respect to the mounting means, the rotational axis being perpendicular to a line of the rigid portion of the banner holding means, and the rotational axis extending from a point where the swivel means connects to the banner holding means, and connects substantially to a center point of the banner hold means.

15. The apparatus of claim 14, wherein the banner comprises a flag.

16. The apparatus of claim 14, wherein the swivel means removably connects to the banner holding means.

17. The apparatus of claim 14, wherein the swivel means removably mounts to the mounting means.

* * * * *